US006020879A

United States Patent [19]

Nakabayashi

[11] Patent Number: 6,020,879

[45] Date of Patent: Feb. 1, 2000

[54] POWER SAVING CIRCUIT OF LCD UNIT

[75] Inventor: Yoshikazu Nakabayashi, Gunma, Japan

[73] Assignee: NEC Corporation, Tokyo, Japan

[21] Appl. No.: 08/942,736

[22] Filed: Oct. 3, 1997

[30] Foreign Application Priority Data

Oct. 3, 1996 [JP] Japan ..... 8-263230

[51] Int. Cl.[7] ..... G09G 5/00

[52] U.S. Cl. ..... 345/212; 345/102

[58] Field of Search ..... 345/52, 102, 211, 345/212

[56] References Cited

U.S. PATENT DOCUMENTS

| | | | |
|---|---|---|---|
| 5,005,013 | 4/1991 | Tsukamoto et al. | 340/825.44 |
| 5,389,952 | 2/1995 | Kikinis | 345/212 |
| 5,511,201 | 4/1996 | Kamimaki et al. | 364/707 |
| 5,731,794 | 3/1998 | Miyazawa | 345/102 |

FOREIGN PATENT DOCUMENTS

| | | |
|---|---|---|
| 64-33586 | 2/1989 | Japan . |
| 2-280587 | 11/1990 | Japan . |
| 4-50996 | 2/1992 | Japan . |
| 4-114575 | 4/1992 | Japan . |
| 5-257122 | 10/1993 | Japan . |
| 8-50275 | 2/1996 | Japan . |

*Primary Examiner*—Matthew Luu

*Attorney, Agent, or Firm*—Sughrue, Mion, Zinn, Macpeak & Seas, PLLC

[57] ABSTRACT

To realize power saving of an LCD unit according to VESA standard with a low cost, a power saving circuit of the invention comprises screen control means (2, 3, 4) for turning off a back-light of the LCD (5) and stopping display data to be supplied to the LCD, when a vertical synchronous signal output by the LCD control circuit is suspended for a first fixed time; and power control means (6, 7) for stopping a power supply of the LCD, when a horizontal synchronous signal output by the LCD control circuit is suspended for a second fixed time.

3 Claims, 2 Drawing Sheets

POWER SAVING CIRCUIT OF LCD UNIT

BACKGROUND OF THE INVENTION

The present invention relates to a power saving circuit of an LCD (Liquid Crystal Display) unit, and particularly to that according to VESA (Video Electronics Standards Association) standard.

For saving power consumption in a system having an LCD unit, there is a standby function, whereby the LCD unit is controlled in a standby mode with its display screen made inactive when no information is necessary to be displayed, and returned in a normal mode from the standby mode when there is any information to be displayed.

As an example of prior arts for realizing the standby function, there is a method disclosed in a Japanese patent application entitled "Crystal display control circuit" and laid open as a Provisional Publication No. 50996/'92.

In the prior art, an LCD unit is controlled in the standby mode or in the normal mode making use of a standby signal prepared exclusively for the purpose, and so, there must be provided a circuit and software for generating the standby signal, resulting in a high developing cost.

SUMMARY OF THE INVENTION

Therefore, a primary object of the present invention is to provide a power saving circuit of an LCD unit with a low cost which can be controlled only with the vertical synchronous signal and the horizontal synchronous signal supplied according to the VESA standard, making use of existing VESA software.

In order to achieve the object, a power saving circuit of the invention, applied to an LCD unit having an LCD and an LCD control circuit according to a VESA standard for controlling the LCD comprises screen control means and power control means.

The screen control means turn off a back-light of the LCD and stop display data output by the LCD control circuit to be supplied to the LCD, when a vertical synchronous signal output by the LCD control circuit is suspended longer than a first fixed time. The power control means stop a power supply of the LCD, when a horizontal synchronous signal output by the LCD control circuit is suspended longer than a second fixed time.

The screen control means comprises a first counter for counting a number of pulses of the horizontal synchronous signal, the first counter being reset with each pulse of the vertical synchronous signal, and a first comparator for detecting passage of the first fixed time when the number of pulses of the horizontal synchronous signal becomes more than a line number of the LCD.

The power control means comprises a second counter for counting a number of pulses of a dot-clock signal generated by the LCD control circuit, the second counter being reset with each pulse of the horizontal synchronous signal, and a second comparator for detecting passage of the second fixed time when the number of pulses of the dot-clock signal becomes more than a dot number of a line of the LCD.

BRIEF DESCRIPTION OF THE DRAWINGS

The foregoing, further objects, features, and advantages of this invention will become apparent from a consideration of the following description, the appended claims, and the accompanying drawings wherein the same numerals indicate the same or the corresponding parts.

In the drawings.

DETAILED DESCRIPTION OF THE PREFERRED EMBODIMENTS

Now, embodiments of the present invention will be described in connection with the drawings.

Figure 1:
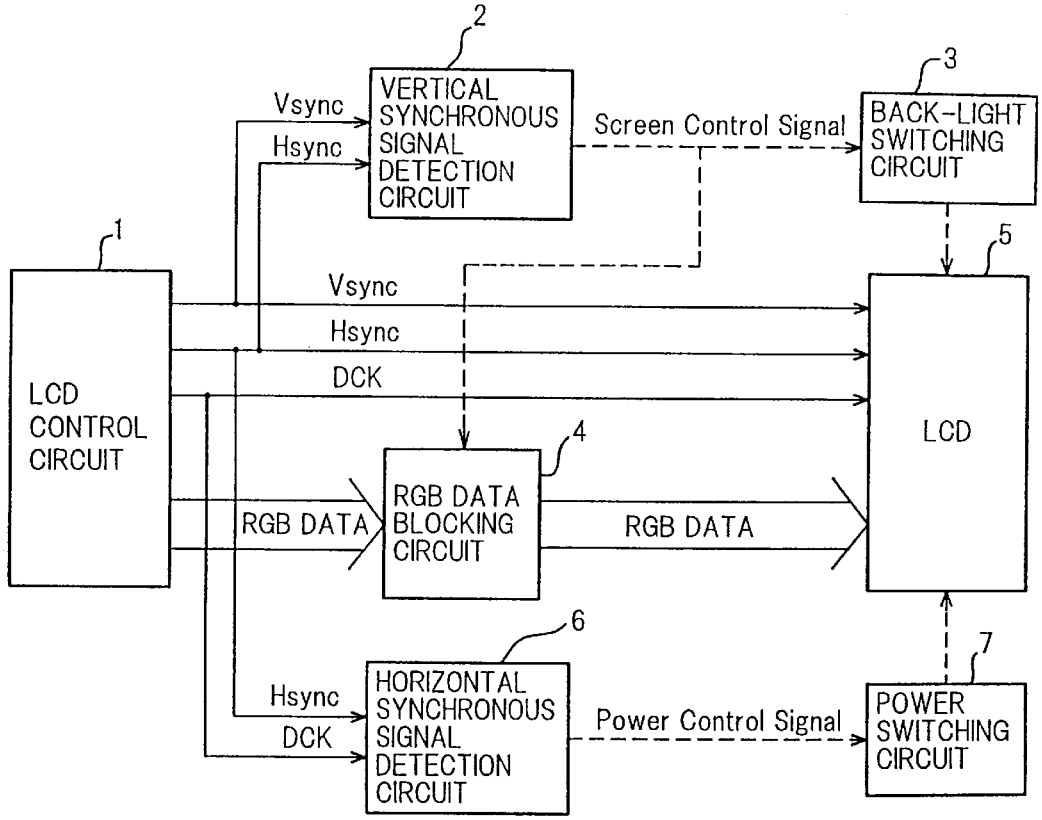
FIG. 1 is a block diagram illustrating an embodiment of the invention.

FIG. 1 is a block diagram illustrating an embodiment of the invention, having;

a vertical synchronous signal detection circuit 2 for generating a screen control signal according to suspension and resumption of a vertical synchronous signal supplied from an LCD control circuit 1, a back-light switching circuit 3 for switching a back-light of an LCD 5 according to the screen control signal, an RGB data blocking circuit 4 for blocking RGB (Red, Green and Blue color) data generated by the LCD control circuit 1 to be supplied to the LCD 5 according to the screen control signal, a horizontal synchronous signal detection circuit 6 for generating power control signal according to suspension and resumption of a vertical synchronous signal supplied from the LCD control circuit 1, and a power switching circuit 7 for switching a power supply to the LCD 5.

Figure 2:
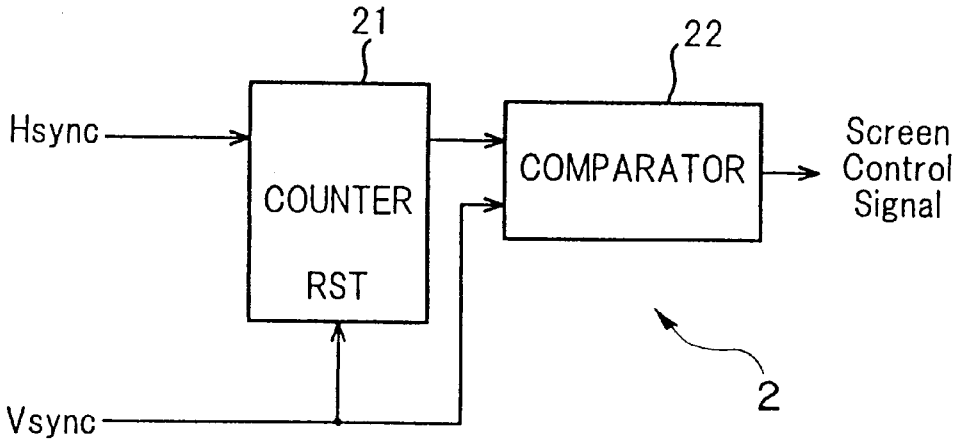
FIG. 2 is a block diagrams illustrating an example of the vertical synchronous signal detection circuit 2 of FIG. 1.
Figure 3:
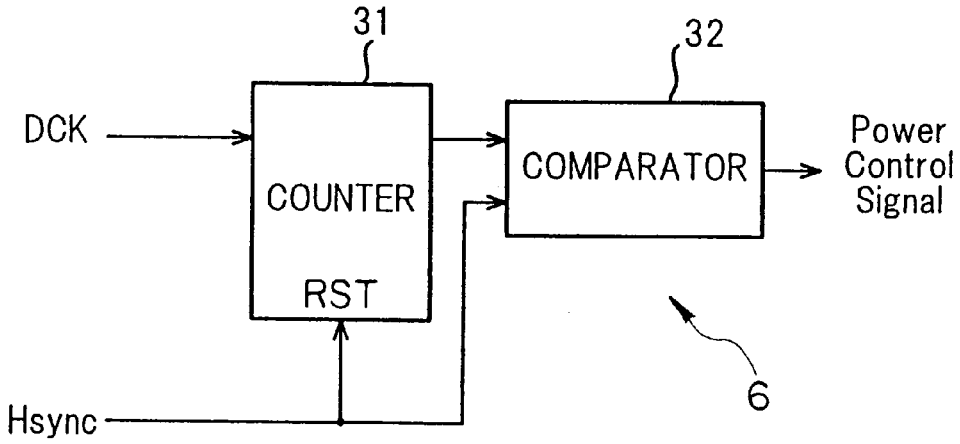
FIG. 3 is a block diagrams illustrating an example of the horizontal synchronous signal detection circuit 6 of FIG. 1.

FIGS. 2 and 3 are block diagrams illustrating examples of the vertical synchronous signal detection circuit 2 and the horizontal synchronous signal detection circuit 6, respectively, of FIG. 1.

Referring to FIG. 2, the vertical synchronous signal detection circuit 2 has a counter 21 and a comparator 22. The counter 21 counts and outputs pulse number of the horizontal synchronous signal supplied from the LCD control circuit 1, which is reset by a pulse of the vertical synchronous signal. The comparator 22 compares the pulse number output from the counter 21 with a first fixed value predetermined according to vertical resolution of the LCD 5, and makes inactive the screen control signal when the pulse number becomes larger than the fixed value.

Similarly as shown in FIG. 3, the horizontal synchronous signal detection circuit 6 has a counter 31 and a comparator 32. The counter counts and outputs pulse number of a dot-clock signal DCK supplied from the LCD control circuit 1, which is reset by a pulse of the horizontal synchronous signal. The comparator 32 compares the pulse number output from the counter 31 with a second fixed value predetermined according to horizontal resolution of the LCD 5. and malkes inactive the power control signal when the pulse number becomes larger than the second fixed value.

Now, operation of the embodiment is described when the LCD 5 has a screen size of 480 lines of 640 dots, by way of example.

Display data are supplied from a graphics accelerator (not shown in the drawings) to the LCD control circuit 1 for controlling the LCD 5 according thereto.

In the VESA standard, there are prepared two states of power saving operation, a suspend-state and an off-state. In the suspend state, the vertical synchronous signal is suspended while the horizontal synchronous signal is suspended in the off-state. The vertical synchronous signal detection circuit 2 and the horizontal synchronous signal detection circuit 6 of the embodiment are provided for detecting suspension and resumption of these two synchronous signals according to the VESA standard.

The counter 21 of the vertical synchronous signal detection circuit 2 counts and outputs pulse number of the horizontal synchronous signal supplied from the LCD control circuit 1, which is reset by each pulse of the vertical synchronous signal supplied from the LCD control circuit 1. Therefore, the pulse number output of the counter 21 does not become more than 480 in a normal state, in the example.

When the comparator 22 detects that the pulse number output of the counter 21 has become more than 480, the vertical synchronous signal is decided to be suspended and the screen control signal supplied to the back-light switching circuit 3 and the RGB data blocking circuit 4 is made inactive. The screen control signal made inactive, the back-light switching circuit 3 turns off the back-light of the LCD 5 and the RGB data blocking circuit stops supply of the RGB data from the LCD control circuit 1 to the LCD 5. Thus, the suspend-state of the VESA standard is realized.

When a pulse in the vertical synchronous signal is received by the comparator 22, the vertical synchronous signal is decided to be resumed and the screen control signal is made active, which controls the back-light switching circuit 3 to turn on the back-light of the LCD 5 and the RGB data blocking circuit 4 to resume supply of the RGB data to the LCD 5. Thus, the suspend state is released.

The counter 31 of the horizontal synchronous signal detection circuit 6 counts and outputs pulse number of the dot-clock signal DCK supplied from the LCD control circuit 1, which is reset by each pulse of the horizontal synchronous signal. Therefore, the pulse number output of the counter 31 does not become more than 640 in the normal state or the suspend-state, in the example.

When the comparator 32 detects that the pulse number output of the counter 31 has become more than 640, the horizontal synchronous signal is decided to be suspended and the power control signal supplied to the power switching circuit 7 is made inactive. The power control signal made inactive, the power switching circuit 7 stops the power supply of the LCD 5. Thus, the off-state of the VESA standard is realized.

When a pulse in the horizontal synchronous signal is received by the comparator 32, the horizontal synchronous signal is decided to be resumed and the power control signal is made active, controlling the power switching circuit 7 to resume the power supply to the LCD 5. Thus, the off-state is released.

As heretofore described, a power saving control of an LCD unit can be realized, in the invention, with a low cost by way of the vertical synchronous signal and the horizontal synchronous signal supplied according to the VESA standard, making use of existing VESA software.

What is claimed is:

1. A power saving circuit of an LCD unit having an LCD, said power saving circuit comprising:

an LCD control circuit according to a VESA (Video Electronics Standards Association) standard, for controlling the LCD;

a screen controller for turning off a back-light of the LCD and stopping display data output by the LCD control circuit to be supplied to the LCD, when a vertical synchronous signal output by the LCD control circuit is suspended for a first fixed time; and a power controller for stopping a power supply of the LCD, when a horizontal synchronous signal output by the LCD control circuit is suspended for a second fixed time;

wherein said screen controller comprises:

a first counter for counting a number of pulses of said horizontal synchronous signal generated by the LCD control circuit, said first counter being reset with each pulse of said vertical synchronous signal; and a first comparator for detecting passage of said first fixed time when said number of pulses of said horizontal synchronous signal becomes more than a first predetermined number;

wherein said power controller comprises:

a second counter for counting a number of pulses of a dot-clock signal generated by the LCD control circuit, said second counter being reset with each pulse of said horizontal synchronous signal; and a second comparator for detecting passage of said second fixed time when said number of pulses of said dot-clock signal becomes more than a second predetermined number.

2. A power saving circuit of an LCD (Liquid Crystal Display) unit having an LCD, said power saving circuit comprising:

an LCD control circuit according to a VESA (Video Electronics Standards Association) standard, for controlling the LCD; and a screen controller for turning off a back-light of the LCD and stopping display data output by the LCD control circuit to be supplied to the LCD, when a vertical synchronous signal output by the LCD control circuit is suspended for a fixed time, said screen controller comprising:

a counter for counting a number of pulses of a horizontal synchronous signal generated by the LCD control circuit, said counter being reset with each pulse of said vertical synchronous signal; and a comparator for detecting passage of said fixed time when said number of pulses becomes more than a predetermined number.

3. A power saving circuit of an LCD unit having an LCD, said power saving circuit comprising:

an LCD control circuit according to a VESA (Video Electronics Standards Association) standard, for controlling the LCD; and a power controller for stopping a power supply of the LCD, when a horizontal synchronous signal output by the LCD control circuit is suspended for a fixed time, said power controller comprising:

a counter for counting a number of pulses of a dot-clock signal generated by the LCD control circuit, said counter being reset with each pulse of said horizontal synchronous signal; and a comparator for detecting passage of said fixed time when said number of pulses becomes more than a predetermined number.

* * * * *

UNITED STATES PATENT AND TRADEMARK OFFICE

CERTIFICATE OF CORRECTION

PATENT NO. : 6,020,879
DATED : February 1, 2000
INVENTOR(S) : Yoshikazu NAKABAYASHI It is certified that error appears in the above-identified patent and that said Letters Patent is hereby corrected as shown below:

Column 3, line 44, delete "horizontal" and insert therefor --vertical--;

line 45, delete "horizontal" and insert therefor --vertical--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*